United States Patent [19]

Gallusser et al.

[11] 4,361,376

[45] Nov. 30, 1982

[54] ELECTRICAL CONNECTOR

[75] Inventors: David O. Gallusser, Oneonta; Valentine J. Hemmer, Sidney; Gary C. Toombs, Oneonta, all of N.Y.

[73] Assignee: The Bendix Corporation, Southfield, Mich.

[21] Appl. No.: 206,769

[22] Filed: Nov. 14, 1980

[51] Int. Cl.[3] ..... H01R 13/46

[52] U.S. Cl. ..... 339/140 C; 339/196 M; 339/206 R

[58] Field of Search ..... 339/206–217, 339/196 R, 196 M, 59, 136, 140

[56] References Cited

U.S. PATENT DOCUMENTS

| | | | |
|---|---|---|---|
| 3,477,061 | 11/1969 | Stephenson | 339/59 |
| 3,512,119 | 5/1970 | Cameron | 339/90 |
| 3,671,921 | 6/1972 | Baker et al. | 339/59 M |
| 3,845,452 | 10/1974 | Eifler | 339/59 R |
| 3,970,352 | 7/1976 | Dorrell et al. | 339/59 M |

FOREIGN PATENT DOCUMENTS

| | | | |
|---|---|---|---|
| 1443193 | 7/1976 | United Kingdom | 339/59 M |

*Primary Examiner*—Joseph H. McGlynn
*Attorney, Agent, or Firm*—Raymond J. Eifler

[57] ABSTRACT

The invention is a one piece molded electrical connector insert that snaps in to a connector housing without the need for additional mounting members or chemical bonding. The insert includes a plurality of resiliently and radially deflectable fingers 21 disposed around the outside of the insert and a second plurality of resiliently and axially deflectable fingers 22 also disposed on the outside of the insert 20 and adjacent to first plurality of fingers 21. The radial fingers 21 and axial fingers 22 completely fill a groove 15 in the inside of a connector housing 10 to prevent axial movement of the insert once it is mounted in the connector housing 10.

6 Claims, 5 Drawing Figures

ELECTRICAL CONNECTOR

This invention relates to electrical connectors and more specifically to the insert within the connector.

An electrical connector assembly is generally comprised of two separate housings, each having contacts matable with contacts in the other one, the housings are connected together by a coupling member. Each of the housings include an insert of dielectric material provided with multiple openings within which electrical contacts are retained. The insert is generally introduced into the housing from the rear and then held in place by some mechanical means or by chemical bonding. An example of one such connector may be found in U.S. Pat. No. 3,876,275 issued Apr. 8, 1975 and entitled "Arrangement for Retaining Electrical Connector Insert". In electrical connectors where the insert is mechanically connected or chemically bonded to the housing, assembly fixtures, special cleaning, or the application of chemical agents and heating of the assembly is required. Further, in arrangements where the insert is snapped into an undercut within the housing axial movement of the insert is present and extra material, such an epoxy or a resilient material, is necessary to prevent such movement of the insert.

DISCLOSURE OF THE INVENTION

This invention provides an insert for an electrical connector that may be easily mounted within the connector housing without the need for chemical bonding or for additional mounting members or assembly fixtures to prevent axial movement.

The invention is an insert for an electrical connector characterized by a first plurality of resiliently and radially reflectable fingers 21 located on the outside of the insert and a second plurality of resiliently and axially deflectable fingers 22 also disposed on the outside of the insert. Both pluralities of fingers 21 and 22 being an integral part of the molded insert.

Accordingly, it is an object of this invention to provide an insert that is easily assembled into the connector housing.

It is another object of this invention to provide an insert for electrical connectors that is comprised of a single integral molded piece that includes the means for mounting the insert inside the connector housing.

It is another advantage of this invention to provide a one-piece insert for a connector assembly that does not move freely in the axial direction after it is mounted.

DETAILED DESCRIPTION OF THE INVENTION

Figures 1, 2, 3, 4, 5:
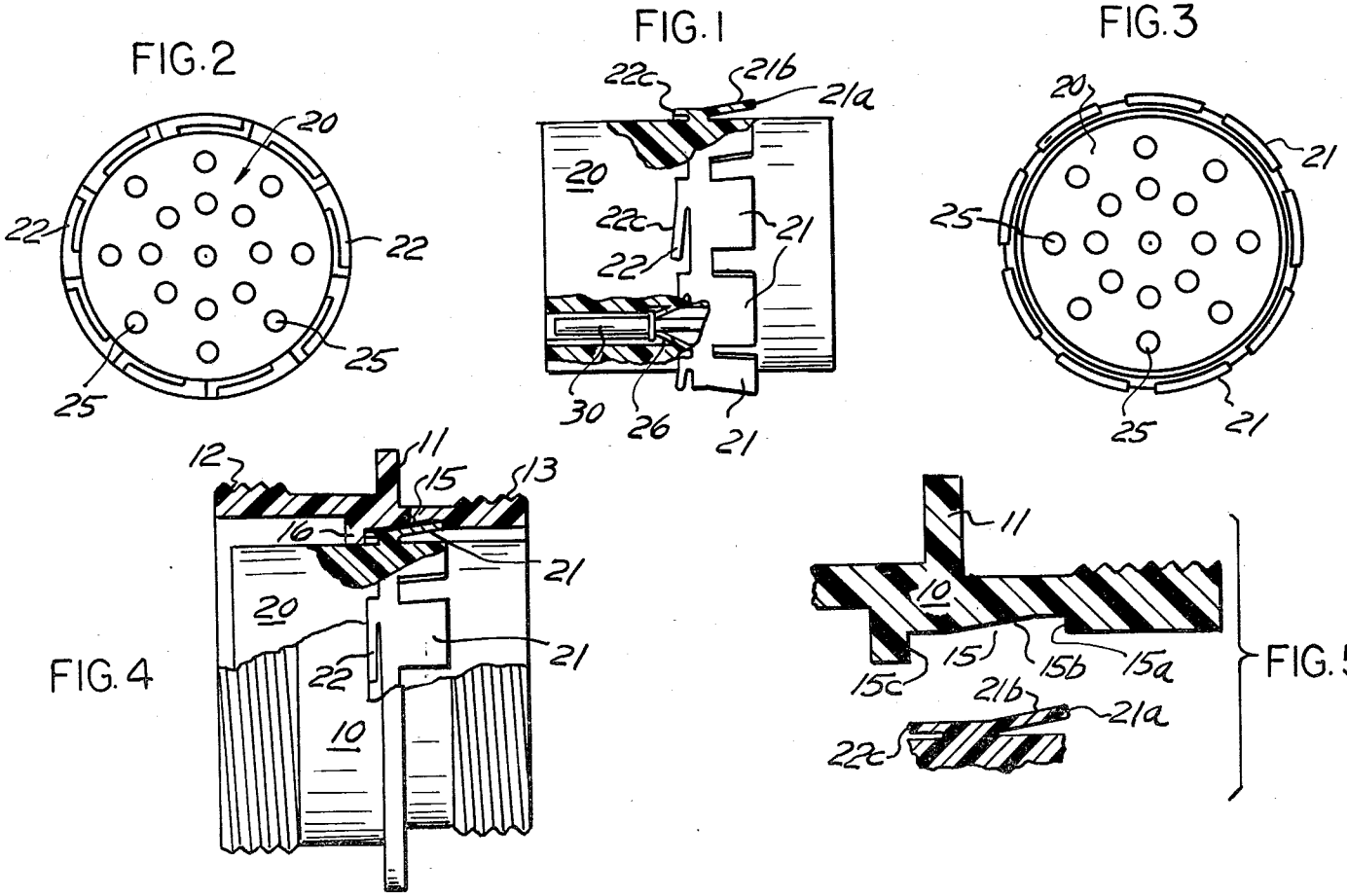
FIG. 1 illustrates an insert incorporating the principles of the invention.
FIG. 2 is a front view of the insert shown in FIG. 1.
FIG. 3 is a rear view of the insert shown in FIG. 1.
FIG. 4 is a diagrammatic view of the insert shown in FIG. 1 mounted in a connector housing.
FIG. 5 is an enlarged view of the groove in the connector housing shown in FIG. 4.

Referring now to the drawings, FIG. 1 illustrates a one piece plastic molded insert 20 which includes a first plurality of resiliently and radially deflectable fingers 21 disposed around the outside of the insert 20 and a second plurality of resiliently and axially deflectable fingers 22 also disposed on the outside of the insert 20 and adjacent the first plurality of fingers 21. The first and second plurality of fingers being an integral part of the one-piece molded insert 20. Each of the first plurality of radial fingers 21 includes a free end 21*a* and an outer surface 21*b*. Each of the second plurality of axial fingers 22 include an axial facing surface 22*c*. Also molded into the insert 20 are a plurality of bores each having contact retaining fingers 26 to retain a contact 30 in the bore.

FIG. 2 shows an end view of the insert 20 and illustrates how the axial fingers 22 are arranged completely around the outside of the insert 20. Although in the preferred embodiment the fingers are arranged completely around the outside of the insert 20, fingers spaced 90° apart may also suffice. The insert 20 also includes a plurality of axially extending bores 25 which are adapted to receive and retain respective contacts.

FIG. 3 illustrates a view of the other end of the insert 20 and illustrates how the radial extending fingers 21 are also arranged around the outside of the insert 20. Although the preferred embodiment shows the radial fingers 21 completely around the outside of the insert 20, fingers spaced 90° apart may also suffice.

FIG. 4 illustrates how the insert 20 is mounted within the connector housing 10. As in most cylindrical connector housings 10, it includes an external annular flange 11, threads 12 on the forward portion and threads 13 on the rear portion. The housing 10 includes an internal annular shoulder 16 and an annular groove 15. The annular groove 15 is adapted to receive the radial fingers 21 and axial fingers 22 of the insert 20. When the insert 20 is properly mounted in the housing 10, the fingers 22, which were axially extending, are depressed rearwardly to take up the slack in the groove 15.

FIG. 5 illustrates an enlarged portion of the groove 15 in the housing 10 and the insert fingers 21 and 22. The groove 15 includes a bottom surface 15*b* and side surfaces 15*a* and 15*c*. The bottom surface 15*b* of the groove 15 is adapted to receive the outer surface 21*b* of the radially extending finger 21. The side surface 15*a* of the groove 15 is adapted to receive the free end 21*a* of the radial finger 21. The other side surface 15*c* of the groove 15 is adapted to receive the forwardly facing side surface 22*c* of the axially extending finger 22.

To mount the insert 20 in the housing 10 the insert 20 is inserted into the rear of the housing 10 until the deflected fingers 21 snap outwardly into position in the groove 15. The forward movement of the insert 20 as it is inserted into the housing 10 also causes the axially extending fingers to be deflected rearwardly when they abut against the housing shoulder 15*c*. The first and second plurality of fingers operate to entirely fill the space between sides 15*a* and 15*c* of the groove and prevent free axial movement of the insert 20.

While a preferred embodiment of this invention has been disclosed, it will be apparent to those skilled in the art, that changes may be made to the invention as set forth in the appended claims, and in some instances, certain features of the invention may be used to advantage without corresponding use to other features. Accordingly, it is intended that the illustrative and descriptive materials herein will be used to illustrate the principles of the invention and not to limit the scope thereof.

Having described the invention what is claimed is:

1. An electrical connector of the type having a housing, an insert having a plurality of passages, a plurality of electrical contacts disposed within a respective passage in said insert, and means for mounting said insert within said housing characterized by:

a groove on the inside of said housing said groove having a bottom surface and a first side surface adjacent said bottom surface;

a plurality of resiliently and radially deflectable fingers disposed on the outside of said insert, each of said fingers disposed in the groove in said housing so that the end thereof abuts the first side surface of said groove; and a second plurality of resiliently and axially deflectable fingers disposed on the outside of said insert adjacent said first plurality of fingers, each of said fingers disposed in the groove in said housing so that one surface of each fingers abuts a second side surface in said groove opposite the first side surface.

2. The electrical connector insert described in claim 1 wherein said first plurality of fingers (21) are integral with each insert.

3. The electrical connector insert described in claim 1 wherein said first and second plurality of fingers are integral with said insert.

4. An electrical connector of the type having a cylindrical housing, a cylindrical insert having a plurality of passages, a plurality of electrical contacts disposed within a respective passage in said insert, and means for mounting said insert within said housing characterized by:

an axially extending groove on the inside of said housing said groove having a bottom surface and a first side surface adjacent said bottom surface;

a plurality of resiliently and radially deflectable fingers axially arranged on the outside radial surface of said cylindrical insert, each of said fingers disposed in the groove in said housing so that the end thereof abuts the first side surface of said groove; and a second plurality of resiliently and axially deflectable fingers disposed on the outside of said insert adjacent said first plurality of fingers, each of said fingers disposed in the groove in said housing so that one surface of each fingers abuts a second side surface in said groove opposite the first side surface.

5. The electrical connector insert described in claim 4 wherein said first plurality of fingers are integral with said insert.

6. The electrical connector insert described in claim 4 wherein said first and second plurality of fingers are integral with said insert.

* * * * *